United States Patent [19]

Wittrup et al.

[11] 4,411,738

[45] Oct. 25, 1983

[54] PRESS CYCLE REDUCTION FOR WET PRESSED HARDBOARD

[75] Inventors: Bruce A. Wittrup, Hoffman Estates; Kendall D. White, Jr., Palatine, both of Ill.

[73] Assignee: United States Gypsum Company, Chicago, Ill.

[21] Appl. No.: 373,383

[22] Filed: Apr. 30, 1982

[51] Int. Cl.[3] ..... D21H 5/14

[52] U.S. Cl. ..... 162/142; 162/149; 162/165; 162/176; 162/187; 162/225

[58] Field of Search ..... 162/225, 176, 187, 142, 162/149, 150, 165, 206

[56] References Cited

U.S. PATENT DOCUMENTS

| | | | |
|---|---|---|---|
| 1,663,505 | 3/1928 | Mason | 162/150 |
| 2,030,653 | 2/1936 | Quinn | 162/149 |
| 2,046,750 | 7/1936 | Mason et al. | 162/225 |
| 2,234,126 | 3/1941 | Mason | 162/150 |
| 2,642,359 | 6/1953 | Scott | 162/150 |
| 2,766,162 | 10/1956 | Boehm et al. | 162/225 |
| 2,805,946 | 9/1957 | Boehm et al. | 162/149 |
| 3,202,569 | 8/1965 | Coggan et al. | 162/142 |
| 3,533,906 | 10/1970 | Reiniger | 162/225 |
| 4,038,131 | 7/1977 | Baldwin et al. | 162/225 |
| 4,173,248 | 11/1979 | Roberts | 162/225 |

FOREIGN PATENT DOCUMENTS

| | | | |
|---|---|---|---|
| 449167 | 6/1948 | Canada | 162/142 |

*Primary Examiner*—Peter Chin

*Attorney, Agent, or Firm*—Robert M. Didrick; Samuel Kurlandsky; Robert H. Robinson

[57] ABSTRACT

The production of hardboard by the wet press process is speeded up by the incorporation of finely divided fibers in an aqueous slurry of otherwise fast draining wood fibers and a thermosetting binder so that a barrier of said fine fibers is formed during hot pressing of the mat and steam pressure is built up in the mat. The high pressure permits a curing temperature of from about 300° F. to about 350° F. in the core of the mat and a concomitant acceleration of the cure of the binder.

13 Claims, No Drawings

PRESS CYCLE REDUCTION FOR WET PRESSED HARDBOARD

This invention relates to a method for reducing the press residence time required for the curing of a thermosetting binder during the manufacture of wet-pressed hardboard.

One of the more serious drawbacks in a wet-pressed hardboard operation is the long press time required to dry the board and cure the resin used as a binder for the wood fibers therein. Attempts have been made to lower the water content of the wet mat but these have been found to be inefficient. Some manufacturers have used a combination of thermoset and thermoplastic resins to shorten the press time; such is an expensive and not very efficient modification of the wet process.

It is an object of this invention, therefore, to provide a wet-pressed hardboard manufacturing process which affords a higher production rate than was heretofore possible.

It is a related object of this invention to reduce the capital investment for hardboard presses required for the manufacture of a given quantity of hardboard.

It is a related object of this invention to conserve the energy required to heat the presses during the manufacture of wet-pressed hardboard.

It is an object of this invention to provide a method for raising the temperature of the core of the wet mat during pressing to hardboard so that curing of the thermosetting binder is accelerated.

It is a related object of this invention to provide a method for building up a superatmospheric pressure in the wet mat so that superheated steam heats the core to a temperature at which curing of the binder is accelerated.

Now, it has been discovered that the thermosetting resin binder may be cured during a shortened press residence time by incorporating finely divided fibers, such as those which constitute newsprint pulp, in a mat of otherwise fast draining wood fibers, whereby, upon consolidation of the wet mat by heat and pressure in a hardboard press having a screen as the bottom platen, the finely divided fibers form a barrier to the passage of steam from the mat, causing a pressure buildup within the mat and the production of high temperature steam. The rate of curing of the binder is accelerated at the high temperature thus established within the core of the mat.

The invention, then, is a method for the manufacture of hardboard which comprises forming an aqueous slurry of a defiberized wood having a TAPPI SFMC freeness of about 10 seconds or less, a thermosetting binder, and from about 2% to about 15%, based on the total fiber weight, of finely divided fibers; forming a mat by depositing said slurry on a screen and allowing a portion of the slurry water to drain through the screen; placing the wet mat in a hardboard press having an imperforate platen on one side and a screen on the other platen; consolidating the wet mat in the press to the desired thickness and forming a barrier of finely divided fibers in the mat, whereby steam pressure is built up in the mat and the setting of the binder is accelerated by heating the wet mat in the press to a core temperature of from about 300° F. to about 350° F.

The defiberized wood used as the base material in the formation of the mat is in the form of feltable fibers and may be obtained in any suitable manner but, preferably, the wood is defiberized in conventional disc refiner apparatus such as a Bauer refiner or Sunds Defibrator. Feltable fibers suitable for this method may also be obtained by comminuting straw, cane, bagasse, and the like. The fibers are preferably obtained from wood chips which have been pressure refined, i.e., cooked at high temperatures at from about 20 p.s.i. to about 200 p.s.i.

The TAPPI SFMC freeness is determined by the procedure and apparatus developed by the Structural Fiber Materials Committee of the Technical Association of the Pulp and Paper Industry. Thus, the freeness of the defiberized wood is expressed in terms of drainage time and may be as little as 1 second but preferably is from about 5 seconds to about 10 seconds.

The thermosetting binder is a phenolic resin or other suitable water-insoluble resin which cures rapidly at temperatures of 300° F. (149° C.) or higher.

Newsprint pulp, mentioned above as a source of the finely divided fibers suitable for this invention, is well known as a slow draining material. The technique for making it is also well known in the pulp and paper industry. Other pulps and gel-like materials which drain at least as slowly as newsprint pulp may be made by the extensive refining of other cellulosic and lignocellulosic fibers. The freeness of slow draining pulps is frequently but not necessarily expressed as the Canadian standard freeness. The pulps and gel-like materials contemplated for use in this invention usually have a Canadian standard freeness of about 450 mls. or slower but one having a higher freeness is satisfactory as long as the finely divided fibers form the barrier during pressing of the mat. A Canadian standard freeness or its equivalent of about 250 mls. or less is preferable. Other sources of the finely divided fibers, besides newsprint pulp, are exemplified by an aqueous slurry of a Bauer softwood pulp which has been beaten extensively and a kraft gel. A kraft gel is a highly hydrated gelatinous substance made by first hydropulping a kraft paper and then serially refining the pulp through a multiplicity of refiners such as, for example, Morden refiners equipped with lava tackle. It has a Canadian standard freeness of about 100 mls. or less.

The weight of such finely divided fibers is preferably from about 5% to 10% of the total fiber weight; a 5% loading is particularly preferred.

Finely divided clay and talc are also contemplated as substitutes for the finely divided fiber.

An aqueous slurry of the defiberized wood, binder and finely divided fibers is formed in any suitable type of apparatus, the slurry having a consistency of from about 1% to about 6%, usually from about 2% to about 3%. The amount of binder may range from about 1% to about 10% but it is preferably from about 1% to about 3%, based on the total fiber weight. From about 1% to about 5%, on the same basis, of a wax, wax-rosin mixture or other sizing agent may also be added to the slurry. The binder and the sizing agent are usually added in the form of aqueous emulsions; the amounts given above refer to the weight of solids added. Conventional additives such as, for example, those used to adjust pH, control retention, or suppress foam, may be added.

The slurry is formed into a mat on a screen passing over a suction box such as in a Fourdrinier machine or an Oliver board former. Part of the water drains away from the fibers, leaving a very wet mat. This wet mat is then placed in a heated hardboard press where additional water is squeezed out through a screen on one platen but the finely divided fibers soon begin to clog the voids in the mat and form a barrier to the passage of steam. The heated platens are at a temperature much above the normal boiling point of water; typically, the press temperature is about 400° F. to about 500° F. The barrier, by temporarily preventing the escape of steam from the mat, causes a buildup of steam pressure within the mat and a rapid temperature rise during the first 30 seconds of press time. A temperature of from about 300° F. to about 350° F. in the core of the mat may be held for from about 0.5 minute to about 2.5 minutes or even longer. Preferably, the core temperature is from about 325° F. to about 350° F. At these elevated temperatures the resin cures at an accelerated rate, sufficiently fast to make possible a press residence time as short as about 5 minutes for a 7/16" thick board; under the same conditions, a thicker board would require a proportionately longer press time. Obviously, much longer press residence times may be used in the practice of this invention but times longer than 20 minutes are not economical. The shorter times, e.g. from about 5 to about 13 minutes, are preferred.

The impacting pressure of the press platens upon the wet mat may range from about 400 to about 3000 pounds per square inch and it may be increased or decreased during the course of one pressing operation.

The board may be taken out of the press while still quite moist and be dried further in a conventional hardboard drying oven. The mositure of board just out of the press will vary according to the amount of finely divided fibers and the press residence time but it is appropriate to the purposes of this invention to have a moisture content of from about 10% to about 25%, by weight, before the board is moved to the oven.

The invention is illustrated further by the following examples in which all parts and percentages are by weight unless otherwise indicated. The defiberized wood in these examples was produced from chipped hardwood tree tops and limbs in a Sunds Defibrator machine and it had a TAPPI freeness of about 8 seconds, as measured by the SFMC method and apparatus. The fiber classification (average of 6 samples) of this material was:

| 12 Mesh | 30 Mesh | 50 Mesh | 100 Mesh | −100 Mesh |
|---|---|---|---|---|
| 19% | 12% | 23% | 18% | 28% |

Each mat contained 1.5% of a phenolic resin (Reichhold 22920 and 1.5% of a sizing wax (Paracol 1802-N), based on the dry weight of said materials as a percent of the total fiber weight.

EXAMPLES 1-9

Ten mats, each measuring 8½"×17" (21.6 cm×43.2 cm), were pressed to 7/16" (1.1 cm) stops between platens heated to 470° F. (about 243° C.) at a platen pressure of about 1500 p.s.i. for 30 seconds and then at about 400 p.s.i. for 12.5 minutes. Three of the mats (Examples 1-3) contained a newsprint pulp having a TAPPI freeness (SFMC) of 200 seconds. The mats of Examples 4-6 contained an extensively refined softwood pulp having a TAPPI freeness (SFMC) of 95 seconds. A kraft gel having a Canadian standard freeness of less than 100 mls. was present in the mats of Examples 7-9. The tenth mat, containing only the defiberized wood, binder and wax, served as the control.

After the 13 minute pressing period, each board was placed in an oven at 325° F. (163° C.) for 3 hrs. Each board was then tested for density, internal bond (IB), 24 hour water absorption (W.A.) and edge swell (E.S.), modulus of rupture (M.O.R.), and modulus of elasticity (M.O.E.). The percent of fine fibers in each board and the test results are shown in Table I.

TABLE I

| Example No. | % Fine Fiber | Density lbs. per cu. ft. | M.O.R.* p.s.i. | M.O.E. p.s.i. $\times 10^{-3}$ | W.A. % | E.S. % | IB p.s.i. |
|---|---|---|---|---|---|---|---|
| Control | 0 | 48.5 | 5217 | 496 | 14.3 | 9.4 | 95 |
| 1 | 5 | 49.3 | 4746 | 542 | 11.5 | 4.6 | 109 |
| 2 | 10 | 48.4 | 4553 | 518 | 12.7 | 6.8 | 121 |
| 3 | 15 | 48.4 | 4534 | 558 | 12.1 | 7.5 | 114 |
| 4 | 5 | 46.3 | 3911 | 403 | 12.3 | 8.7 | 101 |
| 5 | 10 | 48.7 | 5154 | 528 | 12.4 | 7.9 | 123 |
| 6 | 15 | 47.7 | 5011 | 516 | 12.0 | 9.3 | 120 |
| 7 | 5 | 48.2 | 4790 | 356 | 12.9 | 5.5 | 124 |
| 8 | 10 | 47.6 | 4597 | 546 | 14.5 | 9.7 | 99 |
| 9 | 15 | 47.2 | 4179 | 561 | 16.5 | 8.4 | 98 |

*Corrected to density of 50 lbs./cu. ft.
1 lb./cu. ft. = 0.016 grams/cu. cm.
1 p.s.i. = 70.3 grams/sq. cm.

EXAMPLES 10-27

Twenty mats, each measuring 8½"×8½" (21.6 cm×21.6 cm), were pressed to 7/16" (1.1 cm) stops between platens heated to 470° F. (about 243° C.) at a platen pressure of about 700 p.s.i. for 1 minute, then at about 550 p.s.i. for 2 minutes, and at about 400 p.s.i. for the remainder of the press time. Six of these mats (Example Nos. 10-15) contained the newsprint pulp of Examples 1-3. The extensively refined softwood pulp of Examples 4-6 was also present in the mats of Example Nos. 16-21. The mats of Example Nos. 22-27 contained the kraft gel described in connection with Examples 7-9. Two mats containing only the defiberized wood, binder and wax served as controls.

The percent of fine fibers in each mat is shown in Table II, as well as the peak core temperature (measured by thermocouples), the press residence time and the internal bond test results.

TABLE II

| Example No. | % Fine Fiber | Peak Core Temp.* °F. | Press Time minutes | IB p.s.i. |
|---|---|---|---|---|
| Control | 0 | 276 | 9 | 50 |
| Control | 0 | | 20 | 89 |
| 10 | 5 | 310 | 9 | 124 |
| 11 | 5 | | 20 | 143 |
| 12 | 10 | 315 | 9 | 81 |
| 13 | 10 | | 20 | 113 |
| 14 | 15 | 325 | 9 | 111 |
| 15 | 15 | | 20 | 120 |
| 16 | 5 | 296 | 9 | 47 |
| 17 | 5 | | 20 | 79 |
| 18 | 10 | 285 | 9 | 46 |
| 19 | 10 | | 20 | 73 |
| 20 | 15 | 300 | 9 | 80 |
| 21 | 15 | | 20 | 91 |
| 22 | 5 | 338 | 9 | 53 |
| 23 | 5 | | 20 | 106 |
| 24 | 10 | 327 | 9 | 95 |
| 25 | 10 | | 20 | 103 |
| 26 | 15 | 342 | 9 | 112 |

TABLE II-continued

| Example No. | % Fine Fiber | Peak Core Temp.* °F. | Press Time minutes | IB p.s.i. |
|---|---|---|---|---|
| 27 | 15 | | 20 | 88 |

*Average for mats pressed for 9 minutes and 20 minutes.

EXAMPLES 28–31

Four $8\frac{1}{2}'' \times 8\frac{1}{2}''$ mats, each containing 10% by weight of the kraft gel described above, were pressed to 7/16" stops at 470° F. platen temperature and at a platen pressure of about 700 p.s.i. for 1 minute, then at about 550 p.s.i. for 2 minutes, and at about 400 p.s.i. for the remainder of the press time. Four other mats of the same size but containing only the defiberized wood, binder and wax were pressed under the same conditions. All of the boards thus made were heat treated in an oven at 325° F. for 3 hrs. The peak core temperature, the press residence time, the mositure content (M.C.) of each board as it came out of the press, and the water absorption, edge swelling, and internal bond test data are given in Table III.

TABLE III

| Example No. | Peak Core Temp. °F. | Press Time minutes | M.C. % | W.A. % | E.S. % | IB p.s.i. |
|---|---|---|---|---|---|---|
| Control | 271 | 5 | 25.1 | * | * | * |
| Control | — | 7 | 17.5 | 13.7 | 9.0 | 30 |
| Control | — | 9 | 10.5 | 13.3 | 8.5 | 35 |
| Control | — | 11 | 5.7 | 13.3 | 8.9 | 49 |
| 28 | 329 | 5 | 30.5 | * | * | * |
| 29 | — | 7 | 23.1 | 15.0 | 8.0 | 98 |
| 30 | — | 9 | 15.9 | 14.3 | 7.7 | 132 |
| 31 | — | 11 | 9.4 | 14.0 | 7.8 | 134 |

*Curing not complete; not tested.

In the above examples it can be seen that the internal bond strength increases more rapidly as the core temperature is raised to 300° F. or higher and the freeness of the finely divided fiber is reduced. The internal bond strength is a good measure of the degree of cure of the binder.

While several particular embodiments of this invention have been illustrated, it will be understood that the invention may be modified in many ways within the scope and spirit of the appended claims.

What is claimed is:

1. A method for the manufacture of hardboard which comprises forming an aqueous slurry of a defiberized wood having a TAPPI SFMC freeness of about 10 seconds or less, a thermosetting binder, and from about 2% to about 15%, based on the total fiber weight, of finely divided fibers having a Canadian standard freeness of about 450 mls. or slower; forming a mat by depositing said slurry on a screen and allowing a portion of the slurry water to drain through the screen; placing the wet mat in a hardboard press having one imperforate platen and a screen on the other platen; consolidating the wet mat in the press under a pressure of from about 400 to about 3000 pounds per square inch to the desired thickness and forming a barrier of finely divided fibers in the mat, wherein the press residence time is from about 5 to about 20 minutes for a 7/16" board and is proportionately shorter or longer for a thinner board and a thicker board, respectively; whereby steam pressure is built up in the mat and the setting of the binder is accelerated by heating the wet mat in the press to a core temperature of from about 300° F. to about 350° F.

2. The method of claim 1 wherein the thermosetting binder is a phenolic resin.

3. The method of claim 1 wherein the press residence time is from about 5 minutes to about 13 minutes.

4. The method of claim 1 wherein the core temperature is held at about 300° F. or above for from about 0.5 minute to about 2.5 minutes.

5. The method of claim 1 wherein the finely divided fibers are a newsprint pulp.

6. The method of claim 1 wherein the finely divided fibers have a Canadian standard freeness of about 450 mls. or less.

7. The method of claim 1 wherein the finely divided fibers are a kraft gel having a Canadian standard freeness of about 100 mls. or less.

8. The method of claim 1 wherein the core temperature is from about 325° F. to about 350° F.

9. The method of claim 1 wherein the amount of finely divided fibers is from about 5% to about 10% of the total weight of the defiberized wood and finely divided fibers.

10. The method of any one of claims 1–8 wherein the amount of finely divided fibers is about 5% of the total fiber weight.

11. The method of claim 1 characterized further in that water retained in the cured board is driven off in a drying oven.

12. The method of claim 11 wherein the amount of water retained in the board is from about 10% to about 25%, by weight.

13. The method of claim 1 wherein the press platens apply a pressure of from about 400 to about 3000 pounds per square inch.

* * * * *